US005911611A

United States Patent [19]

Saad

[11] Patent Number: 5,911,611

[45] Date of Patent: Jun. 15, 1999

[54] WATER SKI TRAINING APPARATUS

[76] Inventor: David M. Saad, P.O. Box 17255, St. Paul, Minn. 55117

[21] Appl. No.: 09/086,196

[22] Filed: May 28, 1998

[51] Int. Cl.[6] ..... B63B 1/00

[52] U.S. Cl. ..... 441/73; 434/253

[58] Field of Search ..... 441/68, 69, 73; 114/253; 434/253

[56] References Cited

U.S. PATENT DOCUMENTS

| | | | |
|---|---|---|---|
| 2,938,220 | 5/1960 | Puckett | 441/73 |
| 3,125,060 | 3/1964 | Leonard | 114/253 |
| 3,227,126 | 1/1966 | Etzler | 441/69 |
| 3,604,388 | 9/1971 | Brown | 441/69 |
| 3,877,097 | 4/1975 | Gentry . | |
| 4,460,344 | 7/1984 | Notermann . | |
| 4,669,993 | 6/1987 | Storm . | |
| 4,846,690 | 7/1989 | Williams . | |
| 4,981,455 | 1/1991 | Tubens | 441/73 |
| 5,590,908 | 1/1997 | Carr . | |

*Primary Examiner*—Ed L. Swinehart
*Attorney, Agent, or Firm*—James V Harmon

[57] ABSTRACT

A water ski training apparatus is provided which includes a training apparatus body that is adapted to be connected to a water ski tow rope. The training apparatus body supports the user's feet directly or the water skis which in turn support the feet. The apparatus body is disengagable from the skis once the skier rises to a standing position in the water. In one form, the ski training apparatus body has left and right openings for left and right skis. The openings are larger than the skis so that the skis are able to slide easily within the openings and ultimately slide off the front end of each ski once the skier becomes at least partially elevated out of the water to a standing position. A tow rope clamp is supported on the training apparatus body for connecting the body to the tow rope so that the user can hold the end of the tow rope with his hands while the training apparatus body is secured to another portion of the rope by the clamp. In this way the user can be towed by the rope with his feet supported by the training apparatus body.

15 Claims, 6 Drawing Sheets

WATER SKI TRAINING APPARATUS

FIELD OF THE INVENTION

This invention relates to sports equipment and more particularly to apparatus for training water skiers, either with the use of skis or for barefoot water skiing.

BACKGROUND OF THE INVENTION

Various devices have been previously proposed for assisting water skiers. For example, a double-handled rope is described in U.S. Pat. No. 4,846,690. In another device described in U.S. Pat. No. 4,460,344, ropes are provided to tie the skis together. Extra-wide skis have also been described in U.S. Pat. No. 3,877,097. Another method described in U.S. Pat. No. 4,669,993 employed a water ski with a tail fin. None of these devices, however, are able to use the standard ski rope and standard skis while at the same time providing effective assistance for a beginning skier.

Prior to the present invention, barefoot skiers sometimes wrapped their legs over the top of the rope to obtain assistance. This, however, can cause rope burns on the skier's legs. At the present time, there is no effective way to assist a barefoot skier.

In view of these problems, one important objective of the invention is to provide a new training devices that can be used by the whole family and is effective in assisting a water skier while employing standard skis and ski ropes.

Another objective of the invention is to provide a ski training apparatus for use with skis or without skis so that it is able to serve as a barefoot training device that will stabilize a deepwater start. In this application, it is an object of the invention to eliminate rope burns and stabilize the user by widening the user's stance at the start, thus enabling the skier to rise out of the water more easily.

Another important objective of the invention is to provide highly effective assistance, especially for the beginning water skier so that it can be used by adults or children.

These and other more detailed and specific objects of the present invention will be better understood by reference to the following figures and detailed description which illustrate by way of example of but a few of the various forms of the invention within the scope of the appended claims.

SUMMARY OF THE INVENTION

The invention provides a water ski training apparatus which includes a training apparatus body that is adapted to be connected to a water ski tow rope. The training apparatus body supports the user's feet directly or the water skis which in turn support the feet. The apparatus body is disengagable from the skis once the skier rises to a standing position in the water. In one form, the ski training apparatus body has left and right openings for left and right skis. The openings are larger than the skis so that the skis are able to slide easily within the openings and ultimately slide off the front end of each ski once the skier becomes at least partially elevated out of the water to a standing position. A tow rope clamp is supported on the training apparatus body for connecting the body to the tow rope so that the user can hold the end of the tow rope with his hands while the training apparatus body is secured to another portion of the rope by the clamp. In this way the user can be towed by the rope with his feet supported by the training apparatus body.

THE FIGURES

DETAILED DESCRIPTION OF THE INVENTION

Figure 1:
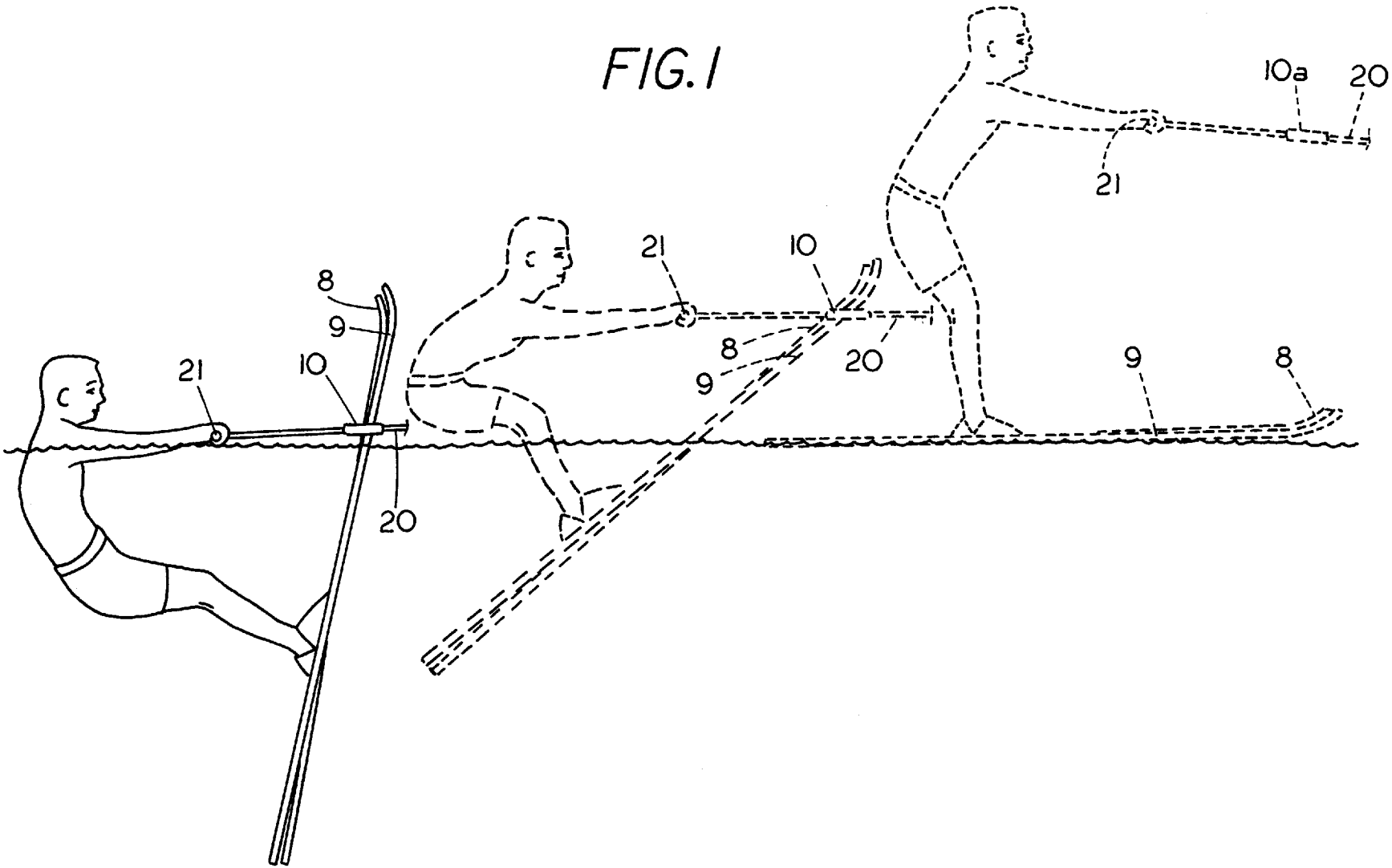
FIG. 1 is a side elevational view showing successive views of a water skier using the invention as the skier rises out of the water at the beginning of a run.
Figure 2:
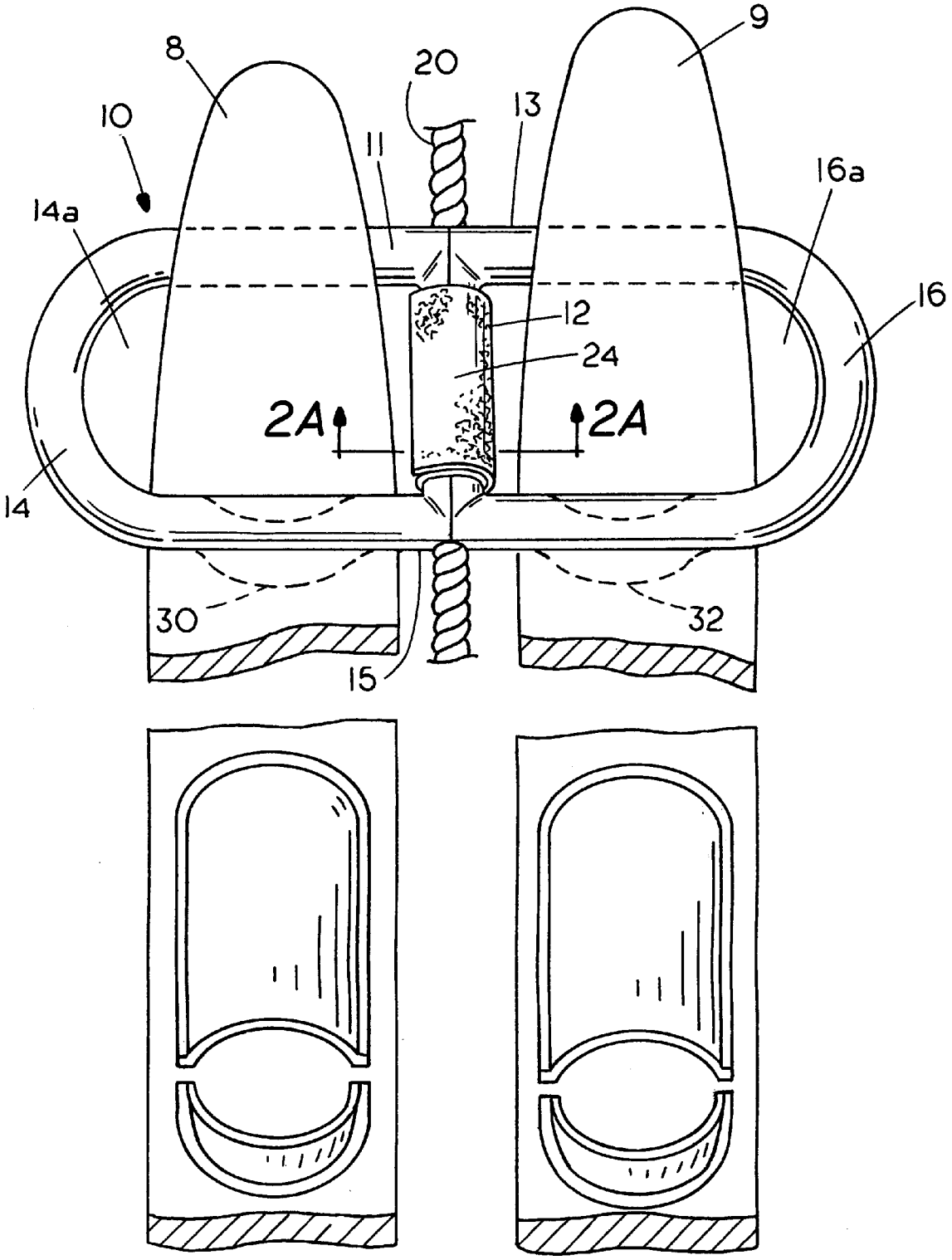
FIG. 2 is a plan view of the invention as it appears during use.
Figure 2A:
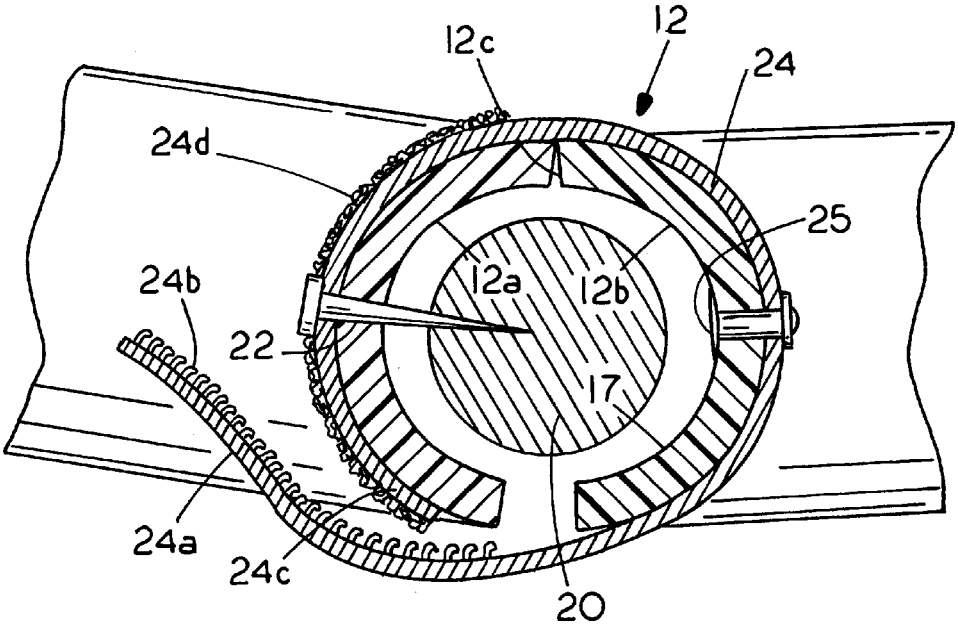
FIG. 2A is a cross-sectional view taken on line 2A—2A of FIG. 1 on a greatly enlarged scale.

Refer now especially to FIGS. 1, 2 and 2A which illustrate the invention as it appears in use for training a novice water skier using water skis.

As shown in FIGS. 1–2A, the water ski training apparatus indicated generally at 10 comprises a ring-shaped training apparatus body 11 that has three major parts including longitudinally extending rope clamp 12 and laterally extending left and right, generally U-shaped ski supports 14 and 16 surrounding openings 14*a* and 16*a* for water skis 8 and 9. The training apparatus body 11 can be formed from steel, high density rubber, aluminum or plastic tubing. The rope clamp 12 comprises longitudinally extending left and right clamp portions 12*a* and 12*b* (FIG. 2A), respectively, that are hinged relative to one another by means of a longitudinally extending upper hinge 12*c* formed from a fabric strap 24. The front end of the clamp is shown at 13 and the rear end of the clamp is shown at 15. The hinge 12*c* can, if desired, comprise a metal or rubber hinge (not shown) of any suitable commercially available construction or, as shown in FIGS. 1 and 2, it can comprise a thin, flexible ligament of fabric extending between the halves 12*a* and 12*b* of the clamp 12 at the top of the clamp in the area of the hinge 12*c* or, if desired, in the alternative a plastic hinge sometimes known as a "living hinge" (not shown) can be used to allow the lower part of the halves 12*a*, 12*b* of the clamp 12 to be spread apart. Within the clamp 12 is a longitudinally extending central bore 17 which is open at both ends to accommodate a conventional water skier's tow rope 20. Extending centrally within the bore 17 are a plurality of surface irregularities, e.g., centrally extending spikes 22, for securely engaging and retaining the tow rope 20 within the clamp 12. The spikes 22 can be formed from metal or, if the training apparatus body 11 is formed from plastic resin, the spikes 22 can be integral with one or both sides 12*a*, 12*b* of the clamp 12. Although spikes 22 can be used, other kinds of surface irregularities can be employed in the alternative, if desired. For example, the inside of the clamp 12 can be serrated or provided with a serpentine central bore 17 having lateral undulations for securely retaining the clamp 12 in place on the rope 20, say, three to six feet from the handle 21 (FIG. 1). In order to prevent the clamp 12 from slipping off the rope 20, any suitable fastening means can be provided, such as the flexible fabric strap 24 (FIGS. 2 and 2A) which is secured to the left side 12*a* of the clamp 12 by the outer ends of spikes 22 or by rivets (not shown). Strap 24 extends toward the right defining the hinge 12*c* and is secured to clamp portion 12*b* by rivets 25. The end 24*a* of strap 24 is provided with a fastener 24*b*, e.g. Velcro® that is connected to another piece of Velcro(® 24*d* at the opposite end of strap 24 to securely hold the clamp 12 in a closed operative mode.

The ski supports 14 and 16 are generally U-shaped so as to provide left and right openings 14*a*, 16*a* for left and right skis 8 and 9. The central ends of each of the supports 14, 16 are rigidly secured to the sides of the clamp 12, e.g. by being integral with the clamp or by welding as shown in the figures. If the training apparatus body 11 is formed from plastic resin, the supports 14, 16 can be molded integrally with the sides 12*a* and 12*b* of the clamp 12.

When the invention is used, the tips of the water skis are placed into the openings 14*a* and 16*a* at the center of the left and right ski supports 14, 16 as shown in FIGS. 1 and 2. As shown in FIG. 2, the rear of each of the U-shaped supports 14, 16 provides secure positioning for the top of the ski while the front of each support 14, 16 provides secure positioning for the lower surface of each ski and the skis in turn support the skier's feet.

Figure 4:
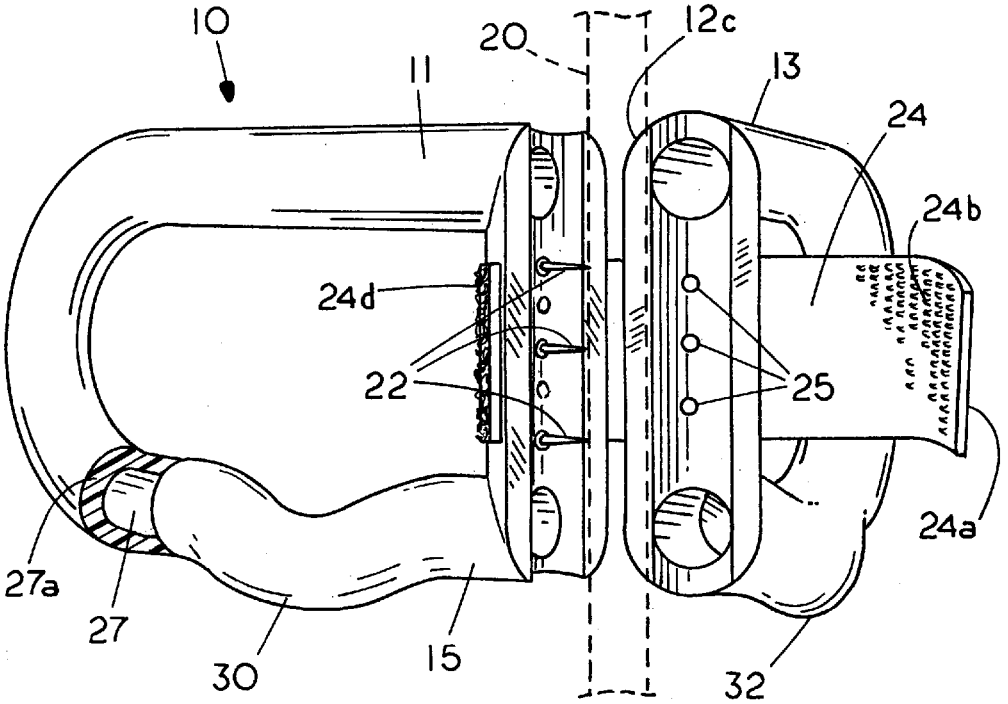
FIG. 4 is a perspective view of the training apparatus of FIG. 3 as it appears when the clamp at the center of the unit is in an open position that permits a tow rope to be inserted or removed from the training apparatus.

The water ski training apparatus 10 is easy to use. The clamp 12 is first opened as shown in FIGS. 2A and 4 and placed over the ski rope 20. The spikes 22 are then passed through the rope 20. The end 24*b* of strap 24 is then attached to Velco(® fastener 24*d* to securely retain the clamp 12 in the closed position on the rope 20 with the spikes 22 extending centrally through the rope 20 so as to hold the rope in place within the clamp 12. The apparatus 10 can be secured to the rope 20 at any selected distance from the handle grip 21 at the free end of the rope 20 according to the height of the skier. To mount the clamp 12, a novice skier can hold the water ski training apparatus 10 under one foot and the ski rope 20 in the other hand, e.g. by the handle 21, and then pull the rope 20 upwards approximately to the height of the her waist. This establishes the distance from the handle 21 at which the apparatus 10 is to be attached to the rope 20. The hinge 12*c* is then closed and the strap portion 24 attached at 24*d*. The skier then sits in the water holding the rope handle 21 with water skis 8 and 9 slid through the central openings 14*a*, 16*a* in each of the supports 14 and 16 as shown in solid lines. The tow boat (not shown) can then begin to tow the skier through the water. As the skier begins to accelerate, the skis are guided correctly by the water ski training apparatus 10 with the skier in the proper stance needed to start her on her way to a successful water skiing experience.

In operation as shown in FIG. 1, the training apparatus body 11 slides progressively further forward on the skis 8, 9 as the skier accelerates and begins to ride higher in the water until the water ski training apparatus 10 finally slides entirely off the front of the skis and rises to the position of an ordinary tow rope at 10*a* in FIG. 1 when a fully erect position is reached. This guiding action of the apparatus followed by release of unit 10 from the skis is highly effective in training beginners.

Figure 3:
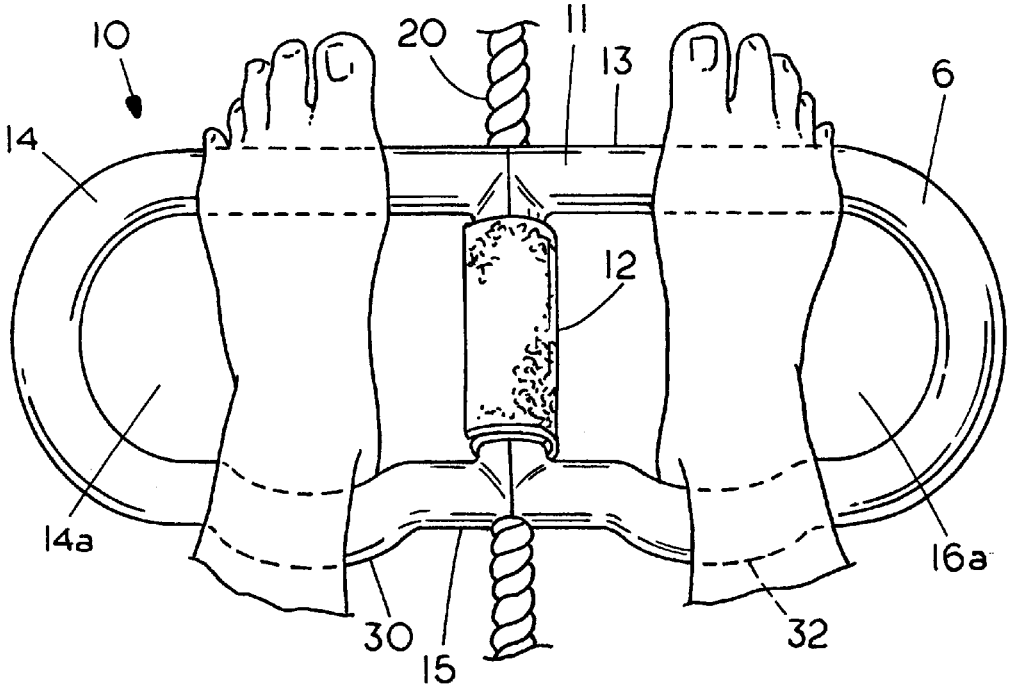
FIG. 3 is a view similar to FIG. 2 showing the invention in use for barefoot water skiing.

Refer now to FIG. 3 wherein the same numerals refer to corresponding parts already described. The rear end 15 of the training apparatus body 11 can, if desired, be provided with foot guides such as heel rests 30, 32 which comprise rearwardly extending, forwardly opening U-shaped bends in the tubing of the apparatus body 11. Successful operation of this form of the invention is also easy to accomplish. The heel rests 30, 32 fit behind the user's ankles while the front part 13 of the support 14 or 16 holds the sole of the foot as shown in FIG. 3. Optional heel rests 30 and 32 are also shown in FIG. 2. The novice barefoot skier can attach the water ski training apparatus 10 at any selected distance from the handle 21, typically a distance that is equal to the distance between the skier's hands and the training apparatus body 11 when placed under the skier's foot. When the barefoot skier is in the water, her heels are placed in the arcuate footrests 30 and 32 (FIGS. 2–4). As the boat (not shown) tows the skier, her legs have a wider stance at the beginning of the run. When the skier is up on her thighs and buttocks, she should sit or lean back a little, lifting each foot successively out of the footrests 30, 32 and into water. This enables one to start barefoot skiing more easily and reliably and with more confidence than heretofore so as to achieve a greatly improved skiing experience. To provide optimum comfort for the user, the training apparatus body 11 is formed from metal or plastic pipe 27 (FIG. 4) surrounded by a thick layer of foam rubber or foam plastic 27*a*.

Figure 5:
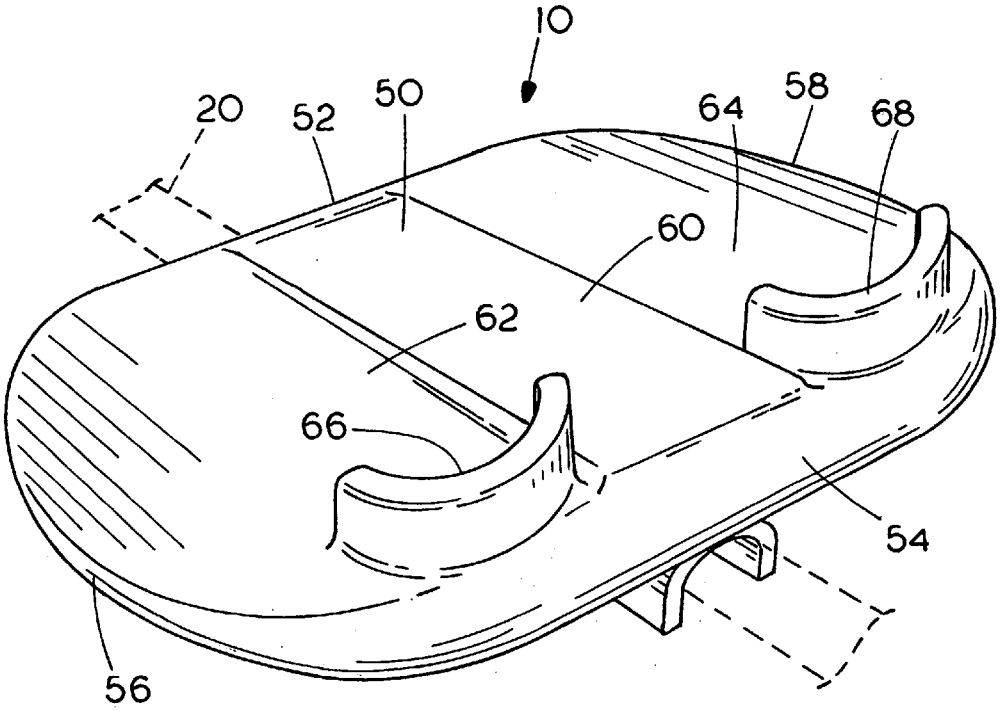
FIG. 5 is a perspective view of the invention with a solid center and the tow rope clamp positioned on the bottom surface thereof.
Figure 6:
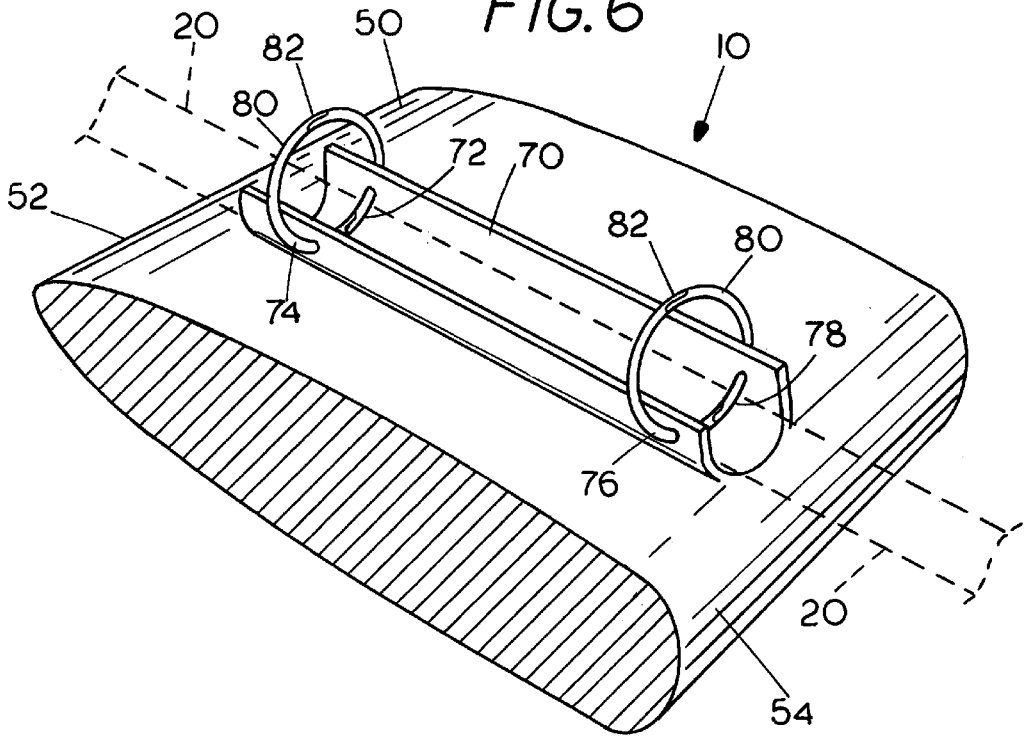
FIG. 6 is a partial bottom perspective view of the apparatus of FIG. 5.

Refer now to FIGS. 5 and 6 in which the water ski training apparatus 10, instead of being made from a metal or plastic ring, has a closed center so as to provide a training apparatus body 50 devoid of openings. It can be formed, for example, from molded plastic resin. The molded plastic resin body 50 has the shape of a flat plate with a forward edge 52, a rear edge 54, and outwardly curved side edges 56 and 58. The body 50 has an upper surface 60 with left and right foot supports 62, 64 at the rear of which are optionally provided generally U-shaped forwardly opening concave heel rests 66 and 68 that are also preferably integral with the apparatus body 50. Alternatively, the foot supports 62, 64 can be foot-shaped pockets or recesses located in the upper surface 60 of the training apparatus body 50, in which case upwardly extending heel rests 66, 68 are not needed. On the bottom surface of the body 50 is an integral longitudinally extending rope-receiving slot or trough 70 with openings at 72–78 for steel hinged rings 80 similar to commercially available key rings which have a hinge 82. During use the rings 80 extend through the openings 72, 74, 76, 78 so as to pierce the tow rope 20, thereby securely holding the rope 20 in the trough 70. If desired, the ring 80 can be replaced by a steel or plastic pin. During use, the training apparatus body 50 is used in the same manner as described in connection with FIGS. 3 and 4 for barefoot skiing. The user simply places his feet as shown on the support surfaces 62, 64 with the heels in the heel rests 66, 68 for barefoot skiing training. The rest of the operation is the same as described above in connection with FIGS. 3 and 4.

Figure 7:
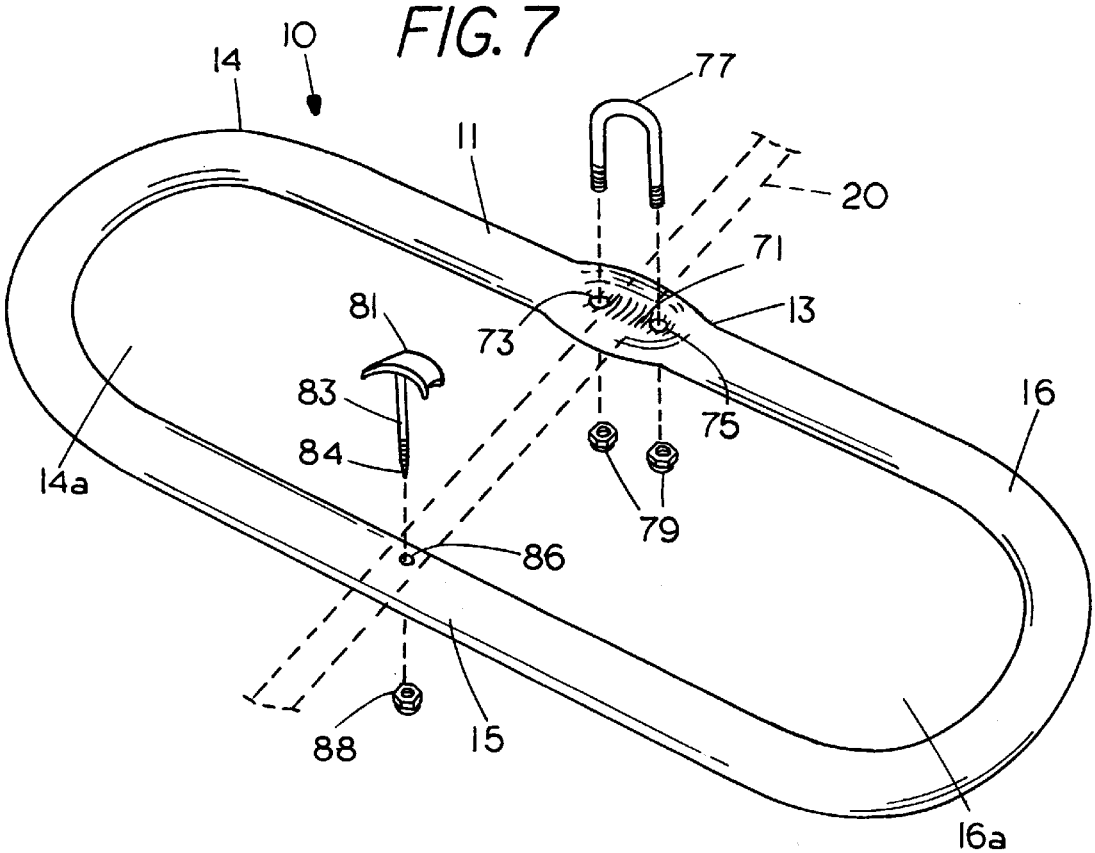
FIG. 7 is a perspective bottom view of the invention showing two additional forms of rope clamps.

Refer now to FIG. 7 wherein the same numeral refer to corresponding parts already described showing two other clamps for securing the rope 20 to the training apparatus body 11. In this case, the training apparatus body 11 is ring-shaped and has no central clamp portion 12. It can be formed from a single ring, e.g. of steel or plastic pipe. At the center of the front end 13 of the training apparatus 10, the pipe is compressed to provide a downwardly opening, laterally extending recess 71 which is bored with a pair of laterally spaced apart openings 73 and 75 for the ends of a U-bolt 77 which during use is placed over the rope 20, passed through the openings 73, 75 and is held in place by nuts 79 on the upper surface of the training apparatus body 11. When the nuts 79 are tightened, the U-bolt 77 will draw the tow rope 20 tightly into the recess 71, thereby securely anchoring the forward portion of the rope 20 to the training apparatus body 11. Another form of clamp is used on the rear portion 15 of the training apparatus body 11. In this case a T-bolt 81 is provided which is threaded at 83 and has a pointed end 84 that is passed through the rope 20 during use and through diametrically opposed openings 86 (only one of which is shown in FIG. 7). The T-bolt 81 is secured in place by means of a crown nut 88. When the nut 88 is tightened, the rope 20 will be securely clamped to the rear portion 15 of the training apparatus body 11. If desired, the bolt 81 can have an ordinary bolt head instead of the C-shaped head shown in the figure. It will be noted that the training apparatus body 11 has no centrally located rope clamp 12 to divide the central opening into two separate openings. Only the rope 20 separates the opening 14*a* for the left ski from the opening 16*a* for the right ski. The operation is the same as described in connection with FIGS. 1–2A.

Figure 8:
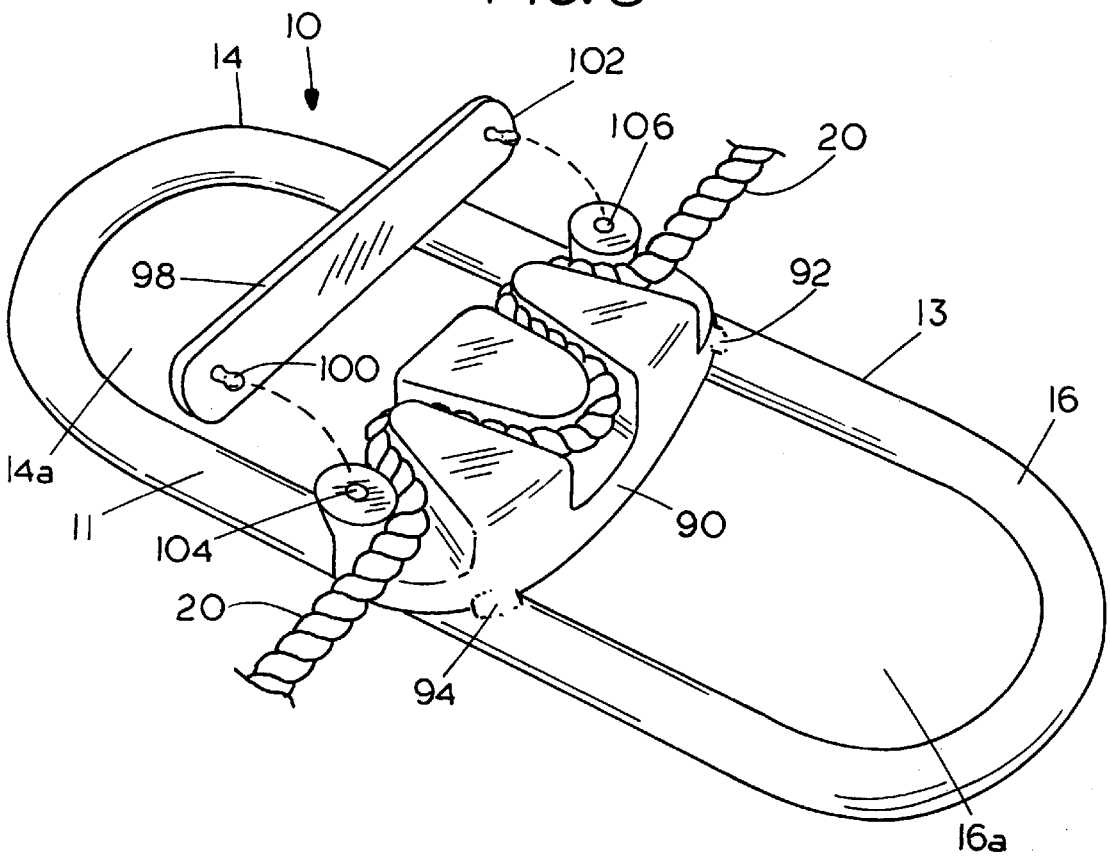
FIG. 8 is a perspective view of the invention showing another form of rope clamp.

Refer now to FIG. 8 in which another form of fastener for the rope 20 is illustrated. In this case a serpentine cleat 90 is welded at 92 and 94 to the front and rear portions 14, 15 of the ring-shaped training apparatus body 11. The serpentine cleat 90 has a serpentine slot 96 in which the rope 20 is placed during operation. To prevent the rope 20 from coming out of the slot 96, it can be held in place by means of a retaining strap 98 that can be made of plastic and includes studs 100, 102 that snap-fit into openings 104, 106 in the upper surface of the cleat 90. Other forms of rope clamps that can be used as will be apparent to those skilled in the art. It will be noted that in the units shown in FIGS. 5–8, the training apparatus body 11 is rigid and does not bend as in FIGS. 2–4.

Many variations of the present invention within the scope of the appended claims will be apparent to those skilled in the art once the principles described herein are understood.

What is claimed is:

1. A water ski training apparatus comprising, a training apparatus body adapted to be connected to a tow rope for engaging at least one water ski, said apparatus body being disengagable from the water ski after a skier has been accelerated sufficiently to raise the skier at least partially out of the water such that the skier can hold onto a hand grip at one end of said tow rope with his hands while the training apparatus is secured to another portion of the rope and the skier can then be towed by the rope with his feet positioned by the training apparatus body until said training apparatus body is disengaged from the water ski and the water skier has been raised at least partially out of the water, and the training apparatus body comprises a body having at least one rope clamp thereon and a left portion thereof has an opening for the left ski and a right portion thereof has an opening for a right ski, with said clamp located therebetween.

2. The water ski training apparatus of claim 1 wherein the training apparatus body has a front and a rear, said clamp holds the rope in a position extending longitudinally between the front and the rear of the training apparatus body, and said openings being sufficiently large to enable the training apparatus body to slide forwardly on the skis as the skier is accelerated and is raised at least partially out of the water whereupon the training apparatus body slides off the front end of the skis and becomes disengaged therefrom.

3. A training apparatus adapted to be connected to a water ski tow rope comprising, a training apparatus body with at least two openings for at least two water skis, each such opening being constructed and arranged to be larger than the cross-sectional dimensions of the ski to permit each such opening to slide on the ski, thereby enabling the training apparatus body to slide off of the forward end of the skis when a skier has been accelerated to a speed which raises the skier at least partially out of the water, and the training apparatus body has a tow rope clamp located centrally between said openings for securing the ski towing rope to the training apparatus body.

4. The apparatus of claim 3 wherein the clamp includes spikes that extend into the rope when the clamp is in an operating mode.

5. A training apparatus adapted to be connected to a water ski tow rope comprising, a training apparatus body including at least one opening for at least one water ski, said opening being constructed and arranged to be larger than the cross-sectional dimensions of the ski to permit each such opening to slide on the ski, thereby enabling the training apparatus body to slide off of the forward end of the ski when a skier has been accelerated to a speed which raises the skier at least partially out of the water, and the training apparatus body has a front and a rear, a tow rope clamp extends from the front to the rear of the body, the clamp includes a hinge for opening the clamp and the clamp has interiorally facing members engageable with the rope for retaining the rope in a clamped position therein.

6. A water ski training apparatus comprising, a training apparatus body having a left and right side and front and rear portions, a tow rope clamp for a water ski tow rope located proximate the center of the training apparatus body to hold a tow rope in a position extending from the front to the rear of the training apparatus body, a first support on the left side of the body for supporting a user's left foot and a second support on the right side of the body for supporting a user's right foot, the rope clamp being located between the left and the right supports enabling the user to hold an end of the rope with her hands while the training apparatus body is secured to another portion of the rope by means of the clamp, such that the user can be towed by the rope with her feet positioned by the training apparatus body during at least the initial stages of rising out of the water to an erect position.

7. The water ski training apparatus of claim 6 wherein the training apparatus body includes at least one opening for a water ski and said opening is slidably engageable over a forward portions of the ski.

8. The training apparatus of claim 6 wherein the first and second supports are ski supports for engaging and supporting water skis which in turn support the skier's feet.

9. The training apparatus of claim 6 wherein the first and second supports are foot supports for supporting each foot of a user such that the user can be raised at least partially out of the water with the feet supported upon the training apparatus body and, after stepping off of the training apparatus body the skier can then ski on bare feet.

10. The training apparatus of claim 9 wherein the training apparatus body comprises a rigid material provided with two foot guides including heel rests comprising rearwardly extending, forwardly opening U-shaped rests at the rear portion thereof to accommodate the user's heels.

11. The training apparatus of claim 9 wherein the training apparatus body has an upper surface and a lower surface, the tow rope is adapted to be connected to extend from the front to the rear portion thereof, and left and right foot supports are provided on the upper surface of the apparatus training body to hold the left and the right foot of the user.

12. The apparatus of claim 11 including heel rests located at the rear of the foot supports for accommodating the user's heels.

13. The apparatus of claim 10 wherein the U-shaped rests are bends in the rear portion of the apparatus body.

14. The apparatus of claim 10 wherein the apparatus body has a bottom surface and the rope clamp is on the bottom surface of the apparatus body.

15. The apparatus of claim 11 wherein the rope clamp is on the bottom surface of the apparatus body.

* * * * *